United States Patent [19]

Focke et al.

[11] Patent Number: 4,694,714

[45] Date of Patent: Sep. 22, 1987

[54] PROCESS AND APPARATUS FOR CHANGING REELS IN CONNECTION WITH PACKAGING MACHINES

[75] Inventors: Heinz Focke; Kurt Liedtke, both of Verden, Fed. Rep. of Germany

[73] Assignee: Focke & Co. (GmbH & Co.), Verden, Fed. Rep. of Germany

[21] Appl. No.: 769,904

[22] Filed: Aug. 27, 1985

[30] Foreign Application Priority Data

Oct. 3, 1984 [DE] Fed. Rep. of Germany ..... 3436217

[51] Int. Cl.[4] ..... B65B 41/10; B65H 19/10

[52] U.S. Cl. ..... 83/13; 83/23; 83/272; 83/370; 83/650; 242/58.4

[58] Field of Search ..... 83/222, 424, 370, 110, 83/156, 395, 175, 13, 23; 242/58, 58.1, 58.3, 58.4; 226/110; 53/64

[56] References Cited

U.S. PATENT DOCUMENTS

| | | | |
|---|---|---|---|
| 3,064,869 | 11/1962 | Cooper | 242/58.3 X |
| 3,398,911 | 8/1968 | Poupin | 242/58.4 |
| 3,843,253 | 10/1974 | Milkan et al. | 83/650 X |
| 3,886,031 | 5/1975 | Taitel | 242/58.4 X |

*Primary Examiner*—Donald R. Schran

*Attorney, Agent, or Firm*—Sughrue, Mion, Zinn, Macpeak & Seas

[57] ABSTRACT

To change reels (11, 12) of packaging material in or on packaging machines, a front region of a connecting sheet (13) is held ready in an exact relative position in a common conveyor track (18). When the end of a run-off sheet (10) is reached, an end piece of the latter is severed, so that the run-off end and the front end of the sheets of material (10, 13) can be conveyed (further) in an exact position to one another.

26 Claims, 2 Drawing Figures

PROCESS AND APPARATUS FOR CHANGING REELS IN CONNECTION WITH PACKAGING MACHINES

SUMMARY OF THE INVENTION

The invention relates to a process for changing reels of sheets of relatively stiff packaging material, especially thin cardboard for severing collar blanks of a hinge-lid (cigarette) pack, in connection with a (cigarette) packaging machine, the running-off sheet of material being supplied along a conveyor track to a severing or packaging unit. The invention also relates to an apparatus for supplying the sheet of material.

The changing of usually large-volume reels (rolls) of packaging material in connection with packaging machines is particularly important because of the productive capacity of packaging machines and the consequently high consumption of material. It is particularly difficult to connect a new reel (connecting sheet) to the end (run-off end) of the used sheet of material (run-off sheet). The purpose of the efforts made in this respect is to change the reels, especially connect up the sheets of material, faultlessly and without stopping the packaging machine.

The invention is concerned with a process and an apparatus for supplying and joining up sheets of material in connection with a packaging machine, the sheet of material preferably consisting of stiff packaging material, for example thin cardboard. In particular, the production of collar blanks used in connection with hinge-lid packs for cigarettes or the like is under consideration here.

The object of which the invention is based is to develop further and improve the process mentioned in the introduction and a corresponding apparatus, in such a way as to guarantee that the front end of a connecting sheet is joined in an extremely accurate way to the run-off end of a run-off sheet and to reduce the incidence of faulty packs or faulty blanks without lowering the working speed of the packaging machine.

To achieve this object, the process according to the invention is characterised in that the following new sheet of material (connecting sheet) is introduced, as a result of the feeding of an initial portion, into the conveyor track of the running-off sheet of material (run-off sheet) adjoining the run-off end of the latter.

In the process according to the invention, therefore, there is a conveyor track which leads to the severing or packaging unit and into which the front end of the connecting sheet is introduced immediately following the run-off end of the run-off sheet, in particular with a short distance between the sheet ends. There is consequently no sheet overlap which can lead to faults in the packaging machine or the severing unit.

The apparatus suitable for carrying out the process is characterised in that each sheet of material has assigned to it a separately switchable drawing or pushing means, especially a pair of (first) draw and push rollers each of which alternately effect the transport or feed of one sheet of material or the other, and in that the two pairs of draw rollers are followed in the conveying direction by a further pair of (second) main draw rollers, to exert a conveying pull force on the particular sheet of material which is running.

The draw and push rollers of the two sheets of material, on the one hand, and the common main draw rollers, on the other hand, are connected to one another in drive terms, thus guaranteeing synchronous running or approximately synchronous running. Consequently, the connecting sheet to be introduced is supplied to the main draw rollers as a result of feeding along the conveyor track, following the run-off end of the run-off sheet.

Arranged in the region of the conveyor track, that is to say between the draw and push rollers on the one hand and the main draw rollers on the other hand, is a cutting unit which severs an end piece of the run-off sheet in exact synchronism with the connecting sheet in terms of time and space, so that the front end of the run-off sheet can directly follow the run-off end of the run-off sheet.

Fixed guides for the sheets of material are formed in front of the draw and push rollers in the conveying direction and along the conveyor track, in a region adjacent to the cutting device, the fixed guides have suction bores for temporarily retaining and aligning the front end of the connecting sheet.

Further features of the invention relate to the constructive design of the cutting device, to the actuation of the latter in conjunction with the control of the draw and push rollers and to the design and functioning of the main draw rollers.

BRIEF DESCRIPTION OF THE DRAWINGS

An exemplary embodiment of the apparatus according to the invention is explained in more detail below with reference to the drawings. In the drawings.

DETAILED DESCRIPTION OF THE DRAWINGS

Figure 1:
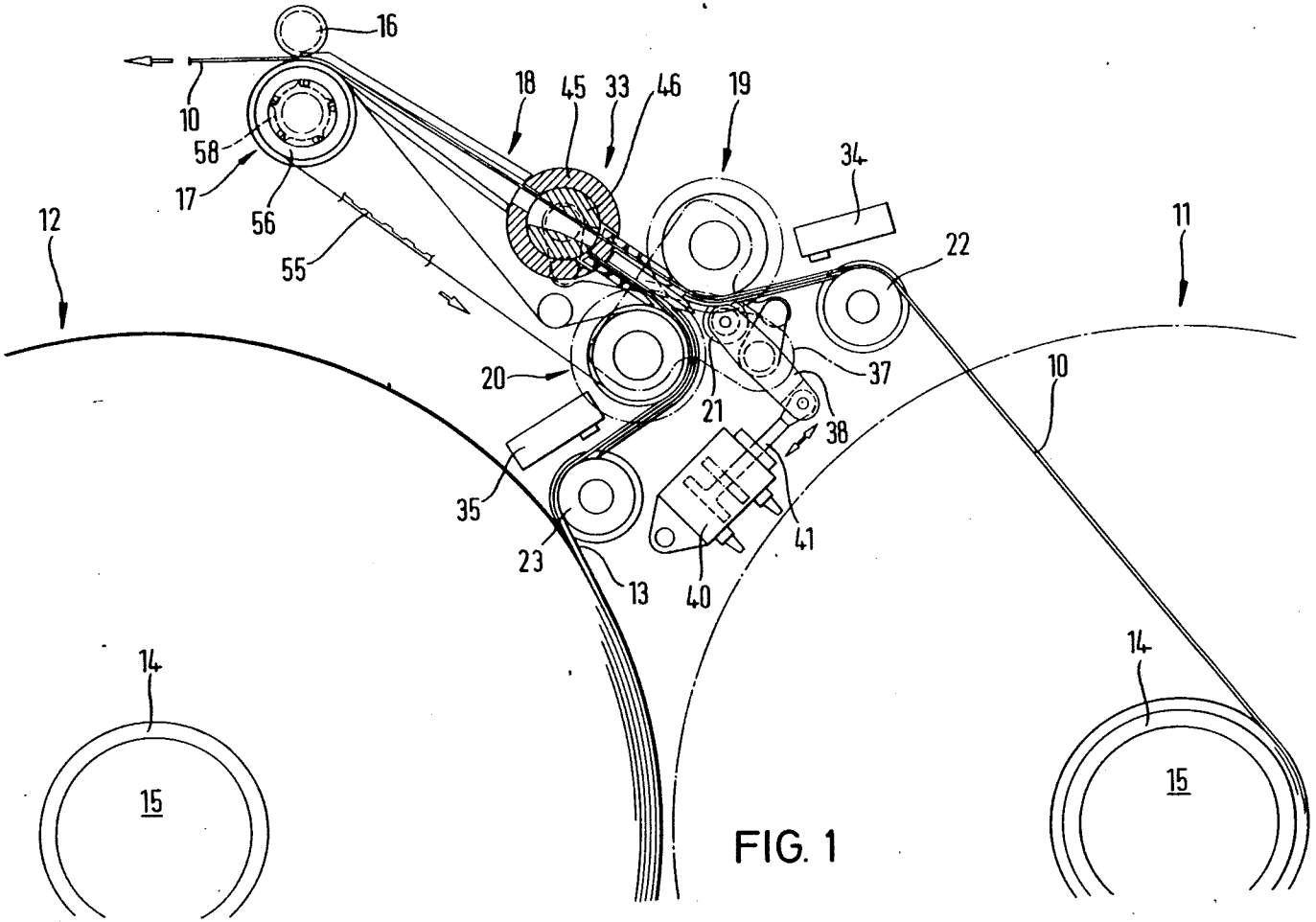
FIG. 1 shows a side view of the apparatus for joining sheets of material to one another.
Figure 2:
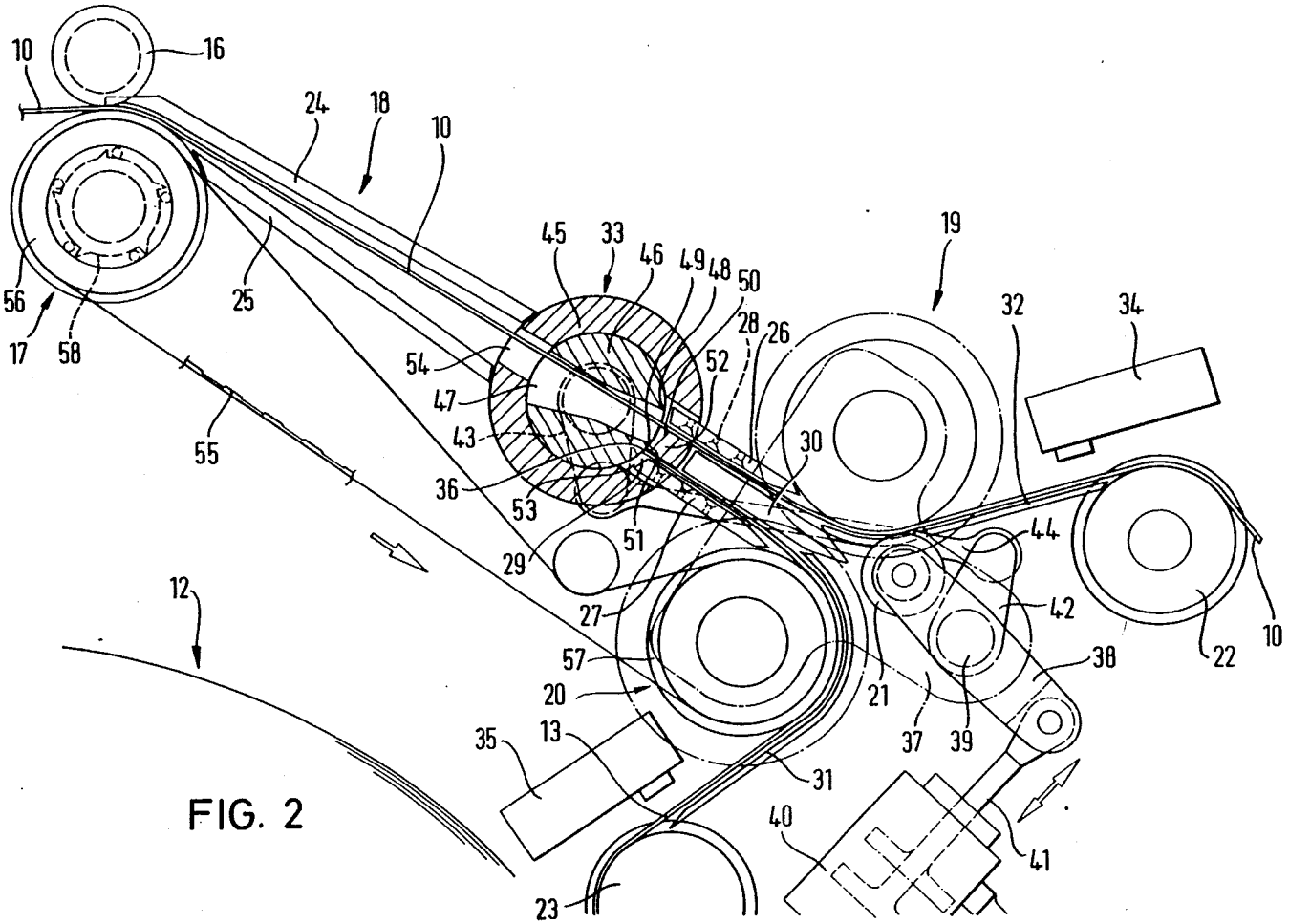
FIG. 2 shows a portion cut out from the apparatus according to FIG. 1, on an enlarged scale.

The apparatus illustrated in an integral part of a packaging machine, especially for producing hinge-lid packs, or is assigned to this. A sheet of material consisting of thin cardboard or the like is supplied continuously at a high conveying speed as a run-off sheet 10 to the packaging machine or a punching unit for producing (collar) blanks. This run-off sheet 10 is drawn off from a first reel 11 which, in the present case, is almost used up. As soon as a run-off end of this active run-off sheet 10 is reached, a new reel 12 or its connecting sheet 13 is introduced into the feed flow and supplied to the packaging machine. An exchange of reels can then take place in the region of the first reel 11, and essentially a cylindrical (cardboard) core 14 merely has to be drawn off from a pivot pin 15 of a supporting device for the reels 11 and 12 which is not shown in detail.

The "active" run-off sheet 10 is conveyed, in particular drawn off from the reel 11, by means of draw rollers. A pair of main draw rollers 16, 17 is assigned to the packaging machine and is arranged at the outlet end of a conveyor track 18 for the sheets of material which, in the present case, is inclined obliquely upwards. Two pairs of draw and push rollers 19 and 20, each for one of the sheets of material 10, 13, are arranged at the opposite inlet end of this conveyor track 18. In the present exemplary embodiment, these pairs of draw rollers each consist of a fixed draw and push ruller 19, 20 in close proximity to one another and of a movable smaller counter-roller 21 which is alternately advanced up to one or other of the draw and push rollers 19, 20 and which is pressed against its periphery and/or against one of the sheets of material 10, 13. The draw and push rollers 19, 20 together with the counter-roller 21 are arranged on the lead-in side of the conveyor track 18, the counter-roller 21 always being movable between the sheets of material 10, 13.

A deflecting roller 22 or 23 for the respective sheet of material 10, 13 is assigned to each of the two draw and push rollers 19, 20 and is located in front of the latter in the conveying direction. These deflecting rollers 22, 23 guarantee that the sheets of material 10, 13 are always guided at a specific angle relative to the draw and push rollers 19, 20.

In a region facing the main draw rollers 16, 17, the conveyor track 18 is defined by fixed lateral or upper and lower guide walls 24, 25. These are arranged to converge in the direction of the main draw rollers 16, 17. The guide walls 24, 25 end immediately adjacent to the periphery of the main draw rollers 16, 17, partly matching the curved path of the run-off sheet 10.

In a region facing the draw and push rollers 19, 20, the conveyor track 18 is limited on the outside by outer walls 26, 27 which are likewise arranged to converge slightly in the conveying direction and which each have suction bores 28 on the inside. These are connected to a vacuum source not shown in detail and are controlled in such a way that a front end 29 of the connecting sheet 13 is fixed in a position of readiness by the suction bores 28 on the associated outer wall 26 or 27. Located between the outer walls 26 and 27 and the two sheets of material 10, 13 is a center piece 30 which limits in respect of the outer walls 26, 27 a relatively narrow guide gap for the sheets of material 10, 13. On the inlet side of the conveyor track 18, the center piece 30 has adjoining it directing walls 31 and 32 which are assigned to the sheets of material 10, 13 and extend up to the deflecting rollers 22 and 23 and which serve for guiding the sheets of material 10, 13 in this region. The above-mentioned directing walls 31, 32 are provided with recesses for the passage of the counter-roller 21.

A cutting device 33 is arranged in the region of the conveyor track 18, specifically at a distance from the main draw rollers 16, 17 and also from the draw and push rollers 19, 20. The function of this cutting device 33 is to sever an end piece of the run-off sheet 10 from the latter when the respective reel 11 is used up. For this purpose, the cutting device 33 is controlled by monitoring means, in the present case optical sensors 34, 35 which both monitor the end of the run-off sheet 10 at corresponding locations in particular immediately adjacent to the deflecting rollers 22, 23. The end piece severed from the run-off sheet 10 by the cutting device 33 is therefore relatively short.

During the time when the run-off sheet 10 is conveyed is the conveyor track 18, the front ends 29 of the connecting sheet 13 to be introduced into the feed flow in the correct position are in a position of readiness, specifically up against a stop 36. When the end piece is severed from the run-off sheet 10, the stop 36 is moved out of the blocking position for the connecting sheet 13 to be introduced into the feed flow in the correct position are in a position of readiness, specifically up against a stop 36. When the end piece is severed from the run-off sheet 10, the stop 36 is moved out of the blocking position for the connecting sheet 13 which at the same time is driven in the conveying direction by the associated draw and push roller 20 together with the counter-roller 21. The movements of the individual members are coordinated with one another in such a way that the front end 29 of the connecting sheet 13 follows the run-off end of the run-off sheet 10 directly, that is to say at a very short distance. As soon as the front end 29 has reached the main draw rollers 16, 17, conveyance is (additionally) taken over by these.

The draw and push rollers 19, 20 and the counter-roller 21 are mounted on a common approximately T-shaped roller carrier 37, the counter-roller 21 being mounted on it indirectly via a (two-armed) actuating lever 38. This is connected to the roller carrier 37 by means of a pivot bearing 39. At the end located opposite the counter-roller 21, an actuating means acts on the actuating lever 38, in the present case a pressure-medium cylinder 40 which can be subjected to a pressure medium in the two directions of movement of a piston rod 41. As a result of pivoting movements of the actuating lever 38, the counter-roller 21 is advanced up to one or other of the draw and push rollers 19, 20.

In the present exemplary embodiment, the cutting device 33 is coupled to the drive for the counter-roller 21. The control signal from the sensors 34, 35 is therefore transmitted to the pressure-medium cylinder 40. To transfer adjusting movements to the cutting device 33, an actuating rod with links 42 and 43 and a connecting rod 44 is guided from the pivot bearing 39 to the cutting device 33.

In the exemplary embodiment illustrated, the cutting device 33 is designed as a rotary cutter. A cylindrical cutting knife 46 is mounted rotatably in a cylindrical knife housing 45. A to-and-fro rotary movement through a limited angle of rotation is executed by means of the link 43.

The cutting knife 46 is provided with a radially extending through-slit 47. The sheet of material 10 or 13 passes through this. On the inlet side, the cutting knife 46 forms cutting edges 48, 49 which interact with counter-edges 50, 51 of a counter-knife 52. The counter-knife 52 is part of the fixed, that is to say non-rotatable knife housing 45 and is arranged in the region of an inlet recess 53 of the latter. This corresponds to the through-slit 47 of the cutting knife 46. An outlet recess 54 is formed opposite it in the knife housing 45. The counter-knife 52 is arranged centrally in the region of the inlet recess 53, so that the sheets of material 10, 13 are guided on both sides of the counter-knife 52. The dimensions of the inlet recess 53 in the peripheral direction are such that the outer walls 26, 27 project into this inlet recess 53.

The cutting knife 46 is so designed or the dimensions of the through-slip 47 of the inlet side are such that a peripheral region of the cutting knife 46 serves as a stop for the front end 29 of the particular connecting sheet 13 in its position of readiness. For this purpose, the through-slit 47 is designed in the inlet region so that, in each of the end positions of the cutting knife 46, a peripheral region adjoining the respective cutting edge 48 or 49 acts as a stop 36. As a result, the front end 29 of the connecting sheet 13 lies practically in the cutting plane. On the outlet side, the relative position of the through-slip 47 in relation to the outlet recess 54 is selected so that the particular run-off sheet 10 running through can be conveyed freely through the knife housing 45 without being impeded.

The main draw rollers 16, 17 and the draw and push rollers 19, 20 are connected to one another in transmission terms. In the present exemplary embodiment, the (larger) main draw roller 17 is driven continuously by means of a motor not shown in the drawings. Via an enveloping drive, in particular via a toothed-belt 55, a toothed-belt pulley 56 of the main draw roller 17 is connected to a corresponding toothed-belt pulley 57 of the draw and push roller 20. This in turn is connected in drive terms to the draw and push roller 19.

The dimensions of the toothed-belt pulleys 56 and 57 and the diameters of the main draw roller 17 and of the draw and push roller 20 are selected so that the draw and push rollers 19, 20 are driven at a slightly lower speed than the main draw roller 17. In particular, the relevant diameters of the draw and push rollers 19, 20 are 0.6 mm less than that of the main draw roller 17. This guarantees that the sheet of material 10, 13 is always transported under slight tension, but in any case free of folds, in the region of the conveyor track 18. The sheet of material 10, 13 is prevented from slipping or from being overstretched because the main draw roller 17 or the toothed-belt pulley 56 assigned to it is equipped with a free-wheel 58 acting in the appropriate direction. The slightly higher speed of the main draw rollers 16, 17 takes effect only during the brief moment after an end piece has been severed from the run-off sheet 10, so that the latter is transported slightly faster than the front end 29 of the following connecting sheet 13.

The severed end piece of the run-off sheet 10 is removed (manually). While the connecting sheet 13 is being conveyed, a new reel can be attached on the pivot pin 15. The (new) connecting sheet is threaded in (manually) by means of the front end until it reaches its position of readiness, in which the front end 29 rests against the stop 36 in the conveyor track 18.

Because the draw rollers are connected in transmission terms, the main draw rollers 16 and 17 and the draw and push rollers 19 and 20 constantly rotate. The conveying action for the sheet of material in the region of the draw and push rollers 19, 20 is generated solely as a result of the contact made by the counter-roller 21.

We claim:

1. An apparatus for introduction of a material sheet made of relatively stiff packaging material, particularly thin cardboard, for manufacturing pieces for rims of a cigarette flip-top pack to at least one of a separation and a packaging system by means of a conveyor track (18) leading to the packaging system, the apparatus comprising:

(a) a first and second reels (11, 12) having first and second sheets (10, 13) wound therearound, respectively;

(b) alternative conveying means (19,20 and 20,21) for alternately conveying the first and second sheets along the conveyor track in a feeding direction, the one of the sheets being conveyed functioning as a run-off sheet, and the other of the sheets functioning as a connecting sheet;

(c) means (16,17), provided following, in the feeding direction, the alternative conveying means, for pulling the run-off sheet along the conveyor track;

(d) a cutting device (33), provided along the conveyor track, for severing an end piece of the run-off sheet;

(e) means (38) for actuating the alternative conveying means; and (f) coupling means (42,43,44), linked with the means for actuating the alternative conveying means, for actuating the cutting device at substantially the same time as the actuation of the alternative conveying means.

2. An apparatus according to claim 1, further comprising means for detecting (34,35) when the run-off sheet is coming to an end, the alternative conveying means being responsive to the detecting means.

3. An apparatus according to claim 1, wherein the cutting device severs the end piece of the run-off sheet at a severing point on the conveyor track, and the apparatus further comprises means for preventing a front end (29) of the connecting sheet from being conveyed beyond, in the feeding direction, the severing point, until the cutting device is operated.

4. An apparatus according to claim 1, wherein the pulling means comprises a pair of main draw and push rollers (16, 17), and the alternative conveying means comprises a pair of fixed draw and push rollers (19, 20).

5. Apparatus according to claim 1, wherein the alternative conveying means comprises a first fixed draw and push roller assigned to one of the run-off sheet and the conveying sheet, a second fixed draw and push roller assigned to the other of the run-off sheet and the conveying sheet, and one of a pressure roller and counter-roller (21) which is alternately common to the one of the run-off sheet and the conveying sheet and the other of the run-off sheet and the conveying sheet and a respective one of the first fixed draw and push roller and the second fixed draw and push roller and which can be advanced alternately toward either one of the first fixed draw and push roller and the second fixed draw and push roller.

6. Apparatus according to claim 5, wherein the counter-roller (21) is mounted centrally so as to be transversely movable between the first fixed draw and push roller and the second fixed draw and push roller and between the one of the run-off sheet and the conveying sheet and the other of the run-off sheet and the conveying sheet, especially on a pivotable actuating lever (38), and as a result of the pivoting of the actuating lever (38) toward either of the one of the run-off sheet and the conveying sheet and the other of the run-off sheet and the conveying sheet.

7. Apparatus according to claim 4, wherein the conveyor track (18) leads to the main draw rollers (16,17), and the conveyor track is made to converge in the feeding direction and is defined at least partially by guide walls (24,25) and outer walls (26,27).

8. An apparatus according to claim 7, wherein a region facing the run-in side of the conveyor track (18) is provided, through the outer walls (26,27), with suction bores (28), facing the run-off sheet and the connecting sheet, for the temporary fixing of the connecting sheet.

9. Apparatus according to claim 5, 6, 7, 8 or 4, wherein the connecting sheet (13) is kept with its front end (29) is a position of readiness in the conveyor track (18) outside the range of movement of the run-off sheet (10), the front end (29) resting against a movable stop (36).

10. Apparatus according to claim 7, 8, or 4, wherein the cutting device (33) is arranged, preferably within the conveyor track (18), in the region between the main draw rollers and the fixed draw and push rollers.

11. Apparatus according to claim 4, wherein the alternative conveying means further comprises a counter-roller, and the coupling means comprises a transmission coupling of the cutting device (33) to the counter-roller (21), so that, when the latter is actuated, the cutting device (33) can likewise be actuated.

12. Apparatus according to claim 11, wherein a link (42) of an actuating rod for the cutting device (33), especically for a rotatable cutting knife (46), is connected to a pivot bearing (39) for the actuating lever (38) of the counter-roller (21), in such a way that the severing of the end piece of the run-off sheet (10) and the drive of the connecting sheet (13) can be executed approximately simultaneously.

13. Apparatus according to claim 12, wherein the cutting knife (46) is designed as a rotary part, especially as a rotary cylinder, in a cylindrical fixed knife housing (45), the cutting knife (46) and knife housing (45) being provided respectively with a radially directed through-slit (47) and an inlet recess (53) and and outlet recess (54) for guiding through either one of the sheets of material (10, 13) therethrough.

14. Apparatus according to claim 13, wherein edges located on the inlet side and intended for limiting the through-slit (47) form in the cutting knife (46) rotatable to and fro cutting edges (48, 49) which interact with counter-edges (50, 51) of a part of the knife housing (45) extending centrally between the sheets of material (10, 13).

15. Apparatus according to claim 13 wherein the cutting knife (46), outside the region of the through-slit (47), acts alternately as a stop (36) for the front end (29) of the connecting sheet (13).

16. Apparatus according to claim 13, wherein outer walls (26,27) are provided along the conveyer track, the outer walls having suction bores (28) for fixing the front region of the connecting sheet (13) which extends into the knife housing (45) up against the stop.

17. Apparatus according to any one of claims 5–8 11–16 and 4, wherein in the region between the fixed draw and push rollers (19,20) and in the adjacent region up to the cutting device (33), a stationary center piece (30) is arranged between the sheets of material (10,13).

18. Apparatus according to claim 1, wherein the pulling means has a slightly higher conveying speed than the alternative conveying means, so that longitudinal tension is exerted in the region between the pulling means and the alternate conveying means on the run-off sheet.

19. Apparatus according to claim 4, wherein the main draw rollers and the fixed draw and push rollers are driven by a common driving force, and the common driving force acting on one of the main draw rollers and being transmitted to one of the draw and push rollers via a driving force transmitting means such as a toothed belt (55).

20. Apparatus according to claim 19, wherein one of the main draw rollers has a slightly larger diameter than each of the draw and push rollers (19,20), and the larger one of the main draw rollers is designed with a free-wheel (58).

21. An apparatus according to claim 19, wherein the larger one of the main draw rollers has a slightly larger diameter than each of the draw and push rollers and is provided with a toothed-belt pulley designed with a free-wheel.

22. A method for replacing a first material sheet (10) which wound around a first reel (11) with a second material sheet (13) which is wound around a second reel (12), the first and second material sheets being made of a relatively stiff packaging material, particularly thin cardboard, for removal of rim pieces of a cigarette flip-top pack, the method being for use in connection with a packaging machine, particularly a cigarette packaging machine, the method comprising the steps of:

(a) passing the first material sheet along a conveyor track (18), in a feeding direction, to at least one of a separation and a packaging system;

(b) delivering the front end (29) of the second material sheet to a first point along the conveyor track;

(c) cutting a trailing end portion of the first material sheet at a second point on the conveyor track, the second point being at substantially the same point as the first point with respect to the feeding direction; and (d) passing the second material sheet along the conveyor track in the feeding direction at substantially the same time as the step of cutting is performed.

23. A method according to claim 22, further comprising a step of preventing the front end (29) of the second material sheet from passing beyond, in the feeding direction, the severing point until the step of cutting is performed, whereby overlap of a connecting material sheet with a run-off sheet is positively prevented.

24. A method according to claim 22 or 23, further comprising a step of detecting when the first material sheet is coming to an end, and wherein the steps of cutting the first material sheet and passing the second material sheet are performed when the first material sheet is coming to an end.

25. A method for replacing a first material sheet (10) which is wound around a first reel (11) with a second material sheet (13) which is wound around a second reel (12), the first and second material sheets being made of a relatively stiff packaging material, particularly thin cardboard, for removal of rim pieces of a cigarette flip-top pack, the method being for use in connection with a packaging machine, particularly a cigarette packaging machine, the method comprising the steps of:

(a) passing the first material sheet along a conveyor track (18), in a feeding direction, to at least one of a separation and a packaging system;

(b) cutting a trailing end portion of the first material sheet at a severing point on the conveyor track;

(c) positioning a front end (29) of the second material sheet substantially at the severing point; and (d) preventing the front end from passing beyond, in the feeding direction, the severing point until the step of cutting is performed.

26. A method according to claim 25, further comprising a step of delivering the front end (29) of the second material sheet to a point along the conveyor track prior to, in the feeding direction, the severing point before completing the step of cutting.

* * * * *